US005908724A

United States Patent [19]

Matsui

[11] Patent Number: 5,908,724

[45] Date of Patent: Jun. 1, 1999

[54] ELECTROPHOTOSENSITIVE MEDIUM AND METHOD OF MANUFACTURING THE SAME

[75] Inventor: Naoyuki Matsui, Tokyo, Japan

[73] Assignee: NEC Corporation, Japan

[21] Appl. No.: 09/069,452

[22] Filed: Apr. 29, 1998

[30] Foreign Application Priority Data

May 1, 1997 [JP] Japan ..... 9-113694

[51] Int. Cl.[6] ..... G03G 5/14

[52] U.S. Cl. ..... 430/58; 430/65; 430/131

[58] Field of Search ..... 430/65, 131, 58

[56] References Cited

U.S. PATENT DOCUMENTS

| | | | |
|---|---|---|---|
| 4,939,057 | 7/1990 | Honda et al. | 430/69 |
| 5,076,899 | 12/1991 | Sakaki et al. | 430/278.1 |
| 5,166,020 | 11/1992 | Fukuda et al. | 430/131 |
| 5,219,691 | 6/1993 | Fukuda et al. | 430/131 |

FOREIGN PATENT DOCUMENTS

| | | | |
|---|---|---|---|
| 59-193463 | 11/1984 | Japan . | |
| 63-316060 | 12/1988 | Japan | 430/131 |
| 4-233550 | 8/1992 | Japan | 430/131 |
| 5-232733 | 9/1993 | Japan | 430/131 |
| 7-319194 | 12/1995 | Japan . | |

*Primary Examiner*—Roland Martin

*Attorney, Agent, or Firm*—Ostrolenk, Faber, Gerb & Soffen, LLP

[57] ABSTRACT

In the manufacture of a photoconductor for electrophotography, an aluminum substrate is heated at a temperature of 430° C. to 550° C. for three or more hours in such a manner that the admittance of an anodic oxidation film to be formed over the aluminum substrate is within a range of 0.4 to 30 S/m2 and the anodic oxidation film has a contact angle by pure water is restricted within a range of 30° to 80°, thus improving the heat resistance of the aluminum substrate. The resulting photoconductor for electrophotography has an adequate degree of heat resistance and can give a good image characteristic even in a high-temperature and high-humidity environment.

14 Claims, 1 Drawing Sheet

ELECTROPHOTOSENSITIVE MEDIUM AND METHOD OF MANUFACTURING THE SAME

BACKGROUND OF THE INVENTION

1. Field of the Invention

The present invention relates to a photoconductor for electrophotography to be used for forming images by an electrophotographic process such as a copying machine, a printer, a facsimile, etc., and a method of manufacturing the photoconductor.

2. Description of the Related Art

In an image producing system employing a photoconductor for electrophotography, firstly electricity is charged on the surface of a photoconducting photosensitive medium as by corona charge and then an electrostatic latent image is formed by light exposure, whereupon the latent image is developed with toner as a visible image. The common problem with the photoconductor for electrophotography of this image producing system is that the photosensitive medium is locally unevenly charged due to, for example, its surface defects, often causing a remarkable image fault such as black spot and fog. For many of various possible causes for such local uneven charging, electric charges are introduced locally between an electrically conductive support and a photoconductive layer. For most of conventional conductive supports, aluminum or an alloy containing chiefly aluminum is used as a substrate, and a blocking layer is disposed between such aluminum substrate and the photoconductive layer in an attempt to eliminate the above-mentioned problem.

This conventional blocking layer is exemplified by a resin layer as of polyamide, polyimide, polyvinyl alcohol, polyurethane, casein or cellulose, and an inorganic layer as of aluminum oxide or aluminum hydroxide. Although the inorganic layer, i.e., the anodic oxidation film itself is a pit-free homogeneous covering film, its uniformity depends on the composition of the substrate because aluminum ions are consumed during the anode oxidation. With the substrate partly crystallized, its surface would become uneven due to dents called pits not only giving a bad influence on formation of the photoconductive layer but causing the image fault.

For the aluminum alloy to be used as the conductive support, usually a small quantity of magnesium (Mg), silicon (Si), copper (Cu) and titanium (Ti) is added in order to secure a constant degree of mechanical strength, and additionally impurities such as iron (Fe) and manganese (Mn) are contained as they originate from the aluminum ingot. These metal elements are crystallized to form local lumps while the aluminum alloy is cast into a tubular substrate. Since they are different in chemical property from aluminum, these crystalline lumps dissolve earlier than aluminum during anode oxidation so that the crystalline lumps near the substrate surface would be removed off to cause pits.

Attempts have been proposed by, for example, Japanese Patent Laid-Open Publications Nos. Sho59-193463 and Hei7-319194, to solve the foregoing problem. Japanese Patent Laid-Open Publication No. Sho59-193463 discloses a technique of regulating the impurity content of iron (Fe) to 2000 ppm or less (a metal of 99.8 or more % by weight) in an effort to avoid above-mentioned faults in a photoconductive layer. Japanese Patent Laid-Open Publication No. Hei7-319194 discloses a technique of controlling electrolytic conditions during anode oxidation to reduce the above-mentioned faults in a photoconductive layer.

However, in the first-named conventional technique, the faults such as pits cannot be prevented even if a high-purity aluminum alloy is used. Also in the second-named conventional technique, the already crystallized lumps cannot be prevented from becoming deteriorated during formation of the aluminum alloy tube. According to these conventional techniques, partly since a high-purity aluminum alloy is used and partly since it is necessary to rectify current with high precision, it would inevitably result in an increased cost of production.

Therefore with the blocking layer using either the anodic oxidation film or the polymer resin, which is obtained by either conventional technique, it would be difficult to eliminate image defects such as black spots and fog, particularly occurrence of fog would be remarkable in a high-temperature and high-humidity environment.

Further, in the method employing the anodic oxidation film, partly since the blocking effect tends to fluctuate and partly since the heat resistance is poor, the substrate would be cracked in its surface while being dried, thus causing the uneven coating during formation of the photoconductive layer and lowering insulator-destruction strength so that the crack can grow into the photoconductive layer.

SUMMARY OF THE INVENTION

It is therefore an object of the present invention to provide a photoconductor for electrophotography with which a good image can be obtained in any environment.

Another object of the invention is to provide a method of manufacturing the photoconductor for electrophotography mentioned in the previous paragraph.

According to a first aspect of the invention, the above first-named object is accomplished by a photoconductor for electrophotography comprising: a tubular aluminum substrate formed by extruding and extracting an aluminum ingot into a tubular shape and by washing such aluminum alloy tube, during which the aluminum alloy ingot or the aluminum alloy tube is heated for three or more hours at a temperature ranging from 430° C. to 550°C.; and an anodic oxidation film formed over an outer circumferential surface of the aluminum substrate ard treated with a sealing process, a contact angle of the anodic oxidation film being in a range of 30° to 80° with respect to pure water, an admittance of the anodic oxidation film being in a range of 0.4 to 30 $S/m^2$.

Preferably the aluminum substrate contains 0.3 or less % by weight of iron (Fe), 0.4 to 0.6% by weight of magnesium (Mg) and 0.1 or less % by weight of manganese (Mn), and has crystallized lumps whose maximum diameter in average is 3 or less $\mu$m. And the crystallized lumps are distributed over the aluminum substrate at 1000 or less per square millimeters.

Further, the anodic oxidation film is sealed at its surface with a nickel acetate solution.

The sealing of the anodic oxidation film is carried out at a temperature of 50 to 70° C. for 4 to 10 minutes.

The nickel acetate solution contains nickel acetate in a concentration of 5 to 10 grams per liter.

Moreover, the anodic oxidation film has a thickness of 20 $\mu$m or less, preferably within a range of 5 to 10 $\mu$m.

According to a second aspect of the invention, the above second-named object is accomplished by a method of manufacturing a photoconductor for electrophotography, comprising the steps of: preparing an aluminum alloy ingot; extruding the aluminum alloy ingot; extracting the extruded aluminum alloy ingot into a tubular aluminum substrate;

heating the aluminum alloy ingot or the aluminum alloy tube at a temperature of 430° C. to 550° C. for three or more hours during the extruding, to form an anodic oxidation film over the outer circumferential surface of the tubular aluminum substrate; washing the tubular aluminum substrate; and sealing the anodic oxidation film with a nickel acetate solution.

Preferably, the sealing of the anodic oxidation film is carried out at a temperature of 50 to 70° C. for 4 to 10 minutes.

Further, the nickel acetate solution contains nickel acetate in a concentration of 5 to 10 grams per liter.

Namely, partly since the tubular aluminum substrate is heated under specified conditions and partly since a settled anodic oxidation film is formed over the outer circumferential surface of the tubular aluminum substrate, the resulting photoconductor for electrophotography is adequately heat-resistant and can give a good image characteristic even in a high-temperature and high-humidity environment.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

Figure 1:
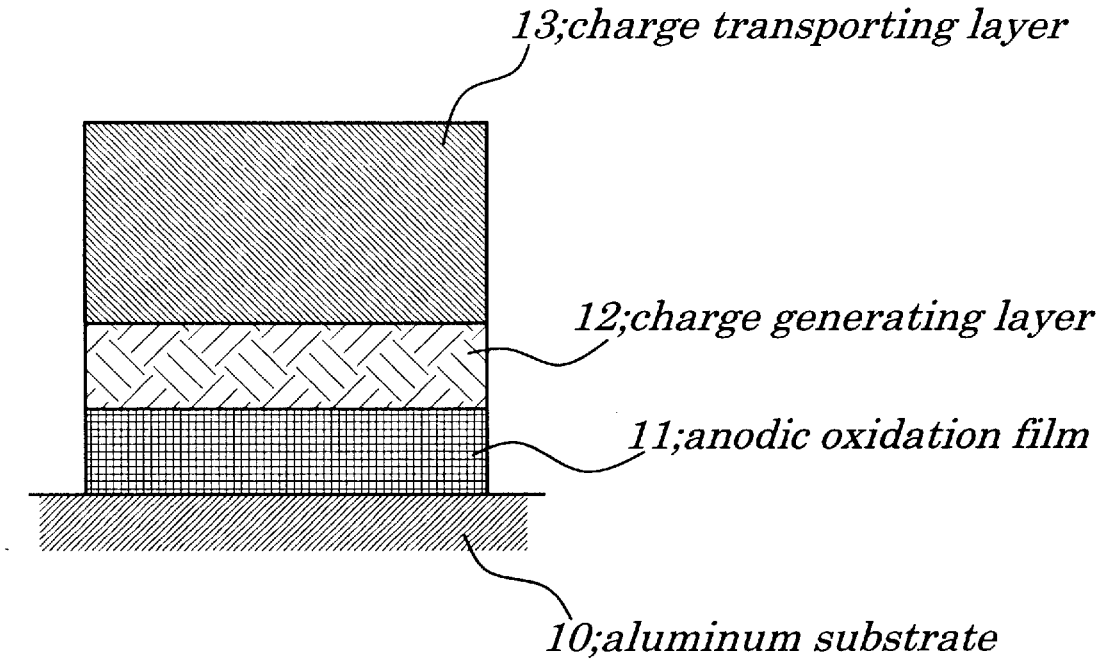
FIG. 1 is a fragmentary schematic cross-sectional view of a photoconductor for electrophotography manufactured according to a method of the present invention.

The principles of the present invention are particularly useful when applied to a photoconductor for electrophotography and its fabrication method, which will now be described in detail.

It turned out from the inventor's studies that local image faults occurred due to the lowering of the local surface potential and that crystallized lumps on the aluminum substrate surface and the size and number of pits formed as the result of removal of crystallized lumps were causes for the lowering of the local surface potential. This is true because small faults originating the crystallized lumps on the aluminum substrate surface cause electric charges to be locally introduced into the photoconductive layer. The inventor discovered also that the quantity of the crystallized lumps would depend on the range of heating temperature while the aluminum alloy cast was extracted and subsequently softened. In an effort to increase the dimensional accuracy of the tubular substrate, it has currently been the common practice that the aluminum alloy cast is extracted, drawn, softened and again drawn, and then this procedure is repeated. This softening softened the metal elements so as to facilitate a subsequent process as it assisted in educing the contained elements other than aluminum as impurities, and as a result, the crystallized lumps were educed or extracted near the substrate surface. Namely, given that the range of heating temperature during casting or softening was appropriately regulated or excluded, it was prevented that any crystallized lumps and then pits causing local faults occurred.

Specifically, by regulating the heating temperature during casting or softening from 430° C. to 550° C., an aluminum substrate was obtained such that crystallized elements of an average diameter equal to or less than 3 $\mu$m were distributed in 1000/mm$^2$ or less.

Further, the elements other than aluminum serve to increase the mechanical strength and hence to make the substrate easy to cut and assume an absolute quantity of the crystallized elements. Consequently the following condition was obtained: iron (Fe) was 0.3 or less % by weight; magnesium (Mg), 0.4–0.6% by weight; and manganese (Mn), 0.1 or less % by weight.

A specified anodic oxidation film was formed on the aluminum substrate obtained by the foregoing procedure, whereupon the photoconductive layer was formed over the anodic oxidation film. As a result, a photoconductor for electrophotography of the present invention was obtained.

The material of the aluminum substrate is preferably an alloy of 6000-system according to Japanese Industrial Standards. It is preferable that the aluminum substrate is defatted with an organic solvent such as alkylene, with an emulsion-defatting agent or with a surface active agent prior to the anode oxidization and is then etched.

Although the anodic oxidation film may be formed by the conventional technique, e.g., by anode-oxidizing in a bath of acid such as sulfuric acid, nitric acid or boric acid, it is anode-oxidized preferably with sulfuric acid. For anode oxidation in sulfuric acid, it is preferable that the sulfuric concentration is 100–200 g/liter, the aluminum ion concentration is 1–10 g/liter, the liquid temperature is about 25° C., the electrolytic voltage is approximately 20 V, and the current density is 0.5–2 A/cm$^2$; the anode oxidation conditions should by no means be limited to these values. For sealing the anodic oxidation film by dipping in a water solution containing nickel acetate, it is preferable that the nickel acetate concentration is 5–10 g/liter, the process temperature is 50–70° C., the process time is 4–10 minutes, and the pH-value is in a range of 4–6. The thickness of the anodic oxidation film is 20 $\mu$m or less, preferably 5–10 Mm. The resulting anodic oxidation film may be washed as with pure water as a demand arises.

Then over the anodic oxidation film, photoconductive layers of below-described organic materials are superposed one over another; at that time, in order to form the individual photoconductive layers uniformly and stably, it requires paint easy to diffuse and dissolve. For this purpose, various kinds of solvents and high-melting-point solvents in particular are used, which of course has to be dried at high temperature to remove the solvent components. If natural oxidation of the anodic oxidation film tends to progress, cracks would occur in the anodic oxidation film surface during the drying. The inventor's studies show that for sealing the anodic oxidation film much heat-resistantly, an admittance equal to or more than 0.4 S/m$^2$ was necessary.

The admittance of the anodic oxidation film may be measured in the following manner. A non-conductive cell is attached to the surface of a sampled specimen, and the specimen is left exposed to a normal-temperature environment for 30 minutes with the cell filled with 3.5% by weight of potassium sulfide solution, whereupon one of the electrodes of an admittance meter is connected to the round of the specimen while the other electrode is inserted into the cell filled with the solution, and an admittance Y is measured at a frequency of 1 kHz. The relationship between the sealing temperature and the dipping time is decided in such a manner that the admittance value is within the range of 0.4 to 30 S/m$^2$.

At the same time, the relationship between the sealing temperature and the dipping time also is decided with consideration that the contact angle with pure water is within the range of 30° to 80°.

The photoconductive layer to be provided on the anodic oxidation film include at least the charge generating layer and the charge transporting layer to be laminated in sequence, and it is also possible to provide various kinds of intermediate layer between the anodic oxidation film and the photoconductive layer.

The intermediate layer may be of any of polyamide, polyvinyl alcohol, polyurethane, polyacrylate and epoxy resin or of a mixture of such individual resin and any of various kinds of additives such as conductive fine grains. The intermediate layer may be a laminate form, i.e., a multilayer form. The thickness of the intermediate layer is 0.1–10 μm, preferably approximately 0.2–4 μm.

In the charge generating layer, charge generating material, such as metal-less phthalocyanin pigment, metal phthalocyanin pigment, azo pigment, disazo pigment, indigo pigment or quinacridon pigment, may be used. These charge generating materials may be used individually or in any combination. To form the charge generating layer, the charge generating material is dispersed in a binder resin. For the binder resin, polyvinyl chloride, polyvinyl acetate, polyvinyl butyral, polyvinylformal, polyester, polyurethane, polycarbonate, acrylic resin and phenolic resin may be used individually or in any combination.

The paint in which the charge generating material and the binder resin are dissolved or dispersed in a solvent, such as toluene, xylene, monochlorobenzene, methyl alcohol, ethyl alcohol, ethyl acetate, methylene chloride, tetrahydrofuran or cyclohexane, is coated by a known coating means, such as a spin coater, an applicator, a spray coater, a bar coater, a dip coater, a doctor knife, to form the charge generating layer. The solvent may be any one or any combination of these substances. The thickness of the charge generating layer is 0.05–5 μm, preferably approximately 0.1–2 μm.

The charge transporting layer is formed by coating over the charge generating layer a charge transporting paint in which the charge transporting substance and a binder resin, which binds the substance as dispersed, are dissolved or dispersed in a solvent. The paint for the charge transporting layer may be an additive serving as an oxidation-preventing agent, a surface lubricant or an ultra-violet absorbent. The charge transporting material is exemplified by poly-N-vinylcarbazol and its derivative, pylene-formaldehyde condensation product and its derivative, polysilane and its derivative, oxazole derivative, oxadiasole derivative, monoallylamine derivative, diallylamine derivative, triallylamine derivative, stilebene derivative, benzidine derivative, pyrazoline derivative, hydrazone derivative, butadien derivative. The charge transporting material may be any one or any combination of these. To form the charge transporting layer, the charge transporting material is dispersed in a binder resin. For the binder resin, polyvinyl chloride, polyvinyl acetate, polyvinyl butyral, polyvinyl formal, polyester, polyurethane, polycarbonate, acrylic resin and phenolic resin may be used individually or in any combination. The solvent may be any one or any combination of toluene, xylene, monochlorobenzene, methyl alcohol, ethyl alcohol, ethyl acetate, methylene dichloride, tetrahydrofuran and cyclohexane. The coating of the charge transporting layer is performed by a known coating means, such as a spin coater, an applicator, a spray coater, a bar coater, a dip coater, a doctor knife. The thickness of the charge transporting layer is 5–40 μm, preferably approximately 15–25 μm.

With the resulting photoconductor for electrophotography, an excellent image characteristic can be obtained without faults such as fog or small black spots under wide-range environmental conditions including a high-temperature and high-humidity condition.

Various examples of the present invention will now be described in detail with reference to the accompanying drawings.

FIG. 1 is a fragmentary schematic cross-sectional view of a photoconductor for electrophotography manufactured by the fabrication method of the invention. In FIG. 1, the photoconductor for electrophotography comprises an aluminum substrate 10, an anodic oxidation film 11 formed on the surface of the aluminum substrate 10, a charge generating layer 12 coated over the anode-oxidized covering film 11, and a charge transporting layer 13.

Using an aluminum alloy of 6000-system according to Japanese Industrial standards as the material of the aluminum substrate 10, after being cast, the aluminum alloy was heated under the conditions shown in Table 1, and an 80 mm diameter, 1.0 mm thickness and 400 mm length cylindrical pipe was extruded under the individual conditions, whereupon the individual resulting pipes were defatted and washed with an organic solvent and were then etched. Subsequently, after washing with water, the individual pipes were anode-oxidized in an electrolytic solution of 150 g/liter sulfuric acid at a DC voltage of 20 V and at a liquid temperature of 25° C. for 15 minutes, thereby forming an anodic oxidation film 11 of a 7 μm average thickness. Then, after washing with water, the individual pipes were sealed under the conditions shown in Table 1, using a 6 g/liter solution chiefly containing nickel acetate. Then, after sufficient washing with water, the individual pipe was dried as a tubular aluminum substrate.

TABLE 1

| Samples | Substrate | Heating Condition | Softening Condition | Sealing Condition | Drum |
|---|---|---|---|---|---|
| Ex. 1 | a | 460° C./ 3 hours | nil | 55° C./ 5 minutes | A |
| Ex. 2 | b | 520° C./ 3 hours | nil | 65° C./ 9 minutes | B |
| Ex. 3 | c | 490° C./ 3 hours | nil | 60° C./ 10 minutes | C |
| Com. Ex. 1 | d | 580° C./ 4 hours | 400° C./ 4 hours | 90° C./ 8 minutes | D |
| Com. Ex. 2 | e | 560° C./ 3 hours | 380° C./ 5 hours | 55° C./ 5 minutes | E |
| Com. Ex. 3 | f | 450° C./ 3 hours | 400° C./ 4 hours | 65° C./ 20 minutes | F |

(N.B.: Ex. Stands for Example and Com. Ex. Stands for Comparative Example.)

The admittance per unit area and the contact angle with pure water of the anode-oxidized 1 of the individual sample substrate along with the quantity of the contained elements are shown in Table 2. The surface of the individual sample substrate was observed by an electronic microscope, and the size and number of the crystallized lumps and pits on the individual sample substrate as analyzed by an image analyzer are shown in Table 3. Further, a heat-resistance test was made on the individual sample substrate in terms of occurrence of cracks, and the test results are shown in Table 4.

TABLE 2

| Samples | Sub-strate | Admittance | Contact Angle | Fe (weight %) | Mg (weight %) | Mn (weight %) |
|---|---|---|---|---|---|---|
| Ex. 1 | a | 9.0 ($S/m^2$) | 62° | 0.1 | 0.5 | 0.1 |
| Ex. 2 | b | 0.52 ($S/m^2$) | 74° | 0.1 | 0.5 | 0.1 |
| Ex. 3 | c | 20.4 ($S/m^2$) | 38° | 0.1 | 0.5 | 0.1 |
| Com. Ex. 1 | d | 0.21 ($S/m^2$) | 86° | 0.5 | 2.0 | 0.5 |
| Com. Ex. 2 | e | 18.2 ($S/m^2$) | 82° | 0.5 | 2.5 | 0.8 |
| Com. Ex. 3 | f | 0.45 ($S/m^2$) | 82° | 0.1 | 0.5 | 0.1 |

TABLE 3

| | | Size and Number of Crystallized Lumps and Pits | |
|---|---|---|---|
| Samples | Substrate | Maximum Diameter (μm) | Number (/$mm^2$) |
| Ex. 1 | a | 1.5 | 200 |
| Ex. 2 | b | 2.0 | 550 |
| Ex. 3 | c | 1.0 | 150 |
| Com. Ex. 1 | d | 4.0 | 3000 |
| Com. Ex. 2 | e | 2.0 | 2500 |
| Com. Ex. 3 | f | 1.0 | 500 |

TABLE 4

| Samples | Substrate | Heat Test (135° C./ 60 minutes × 3 cycles) | Heat Resistance |
|---|---|---|---|
| Ex. 1 | a | no crack occurred | ○ |
| Ex. 2 | b | no crack occurred | ○ |
| Ex. 3 | c | no crack occurred | ○ |
| Com. Ex. 1 | d | cracks occurred | x |
| Com. Ex. 2 | e | no crack occurred | ○ |
| Com. Ex. 3 | f | cracks occurred | x |

(N.B.: the symbol ○ represents "good heat resistance" and x represents "bad heat resistance".)

EXAMPLE 1–3

Over each of the obtained aluminum substrates a–c, a paint in which 2.5 parts by weight of titanyl phtalocyanin and 2 parts by weight of polyvinyl butyral added to 100 parts by weight of tetrahydrofuran were dispersed by a ball mill for 24 hours was coated and was then dried by heating as an approximately 0.2 μm thickness charge generating layer 12.

Then 20 parts by weight of a charge transporting material shown in Formula 1 below and 20 parts by weight of polycarbonate (Z-200, which is a product put on the market from Mitsubishi Gas Chemical, Japanese corporation) were dissolved in 100 parts of methylene chloride, and the resulting solution was coated over the charge generating layer and was then dried by heating as an approximately 20 μm thickness of charge transporting layer 13. Thus the individual photoconductor for electrophotography were obtained as drums A–C.

Formula 1

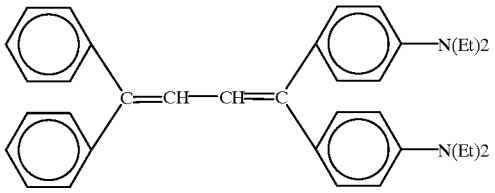

COMPARATIVE EXAMPLES 1–3

Using the obtained aluminum substrates d–f, the photoconductor for electrophotography were manufactured in the same manner as Example 1 as drums D–F.

With each of the thus obtained drums A–F mounted on a page printer (of NEC, Japanese corporation), the exsposure-region potential and the retention were measured in the environment of 25° C. temperature and 50% relative humidity, and the image characteristics were evaluated in various environments. The results of this evaluation are shown in Tables 5 and 6.

TABLE 5

| | | Potential Characteristic (25° C. and 50% Relative Humidity) | |
|---|---|---|---|
| Samples | Drums | Exposure-region Potential (−V) | Retention (%) |
| Ex. 1 | A | 110 | 93.5 |
| Ex. 2 | B | 90 | 92.2 |
| Ex. 3 | C | 98 | 94.2 |
| Com. Ex. 1 | D | 78 | 75.4 |
| Com. Ex. 2 | E | 76 | 71.8 |
| Com. Ex. 3 | F | 79 | 72.0 |

TABLE 6

| | | Image Characteristic Evaluation | | |
|---|---|---|---|---|
| Samples | Drums | 10° C./ 30% RH | 25° C./ 50% RH | 40° C./ 80% RH |
| Ex. 1 | A | good | good | good |
| Ex. 2 | B | good | good | good |
| Ex. 3 | C | good | good | good |
| Com. Ex. 1 | D | uneven coat black spots | uneven coat black spots | uneven coat black spots, fog |
| Com. Ex. 2 | E | black spots | black spots | many black spots, fog |
| Com. Ex. 3 | W | black spots | many black spots | many black spots, fog |

Tables 2–6 show that the maximum diameter in average of either the crystallized lumps or the pits was 3 μm or less and that the number of either the crystallized lumps or the pits was less than 1000 $mm^{-2}$. With the drums A, B, C manufactured using these aluminum substrates a, b, c, no black spots were observed and hence the image characteristics were evaluated as good. From comparison of the quantity of the contained elements between the individual aluminum substrates, it turns out that the image characteristics depend on not only the quantity of the contained elements but the maximum diameter and number of the crystallized lumps and pits.

Further, in the substrates a–c and e, no cracks were occurred while in the substrates d and f, an uncountable number of cracks occurred. In the substrates d and f, the admittance values were relatively low, and it hence turns out that sealing of the substrate surface somehow progressed.

Regarding the potential characteristics, as the result of measurement of the exposure-region potential, the drum D–F were low in sensitivity as compared to the drums A–C. Regarding the retention as the index of electrostatic chargeability, each of the drums D–F of Comparative Examples 1–3 took an inadequate value, which indicates that there generally is a problem in image density. As the result of evaluation of the image characteristics in different environments, with each of the drums A–C a good image free of any fault such as fog or black spots was obtained in every environment while with each of the drums D–F of Comparative Examples 1–3 such faults occurred in every environment; particularly in a high-temperature and high-humidity environment, sever fog occurred, so the drums D–F could not be suitable for practical use.

It turns out from these results that the occurrence of black spots influences on the maximum diameter and number of the crystallized lumps and pits on the aluminum substrates surface; consequently the heating temperature while the aluminum substrate is manufactured must be controlled within the range of 430° C. to 550° C.

Further, when its admittance is less than 0.4 $S/m^2$, the anodic oxidation film is bad in heat resistance so that cracks tend to occur. When its admittance is more than 80 $S/m^2$, the anodic oxidation film does not make adequate blocking effect so that its electrostatic chargeability becomes deteriorated. And the contact angle is regarded as an index of coatability of the paint when the photoconductive layer is formed; particularly if the contact angle is smaller than 30°, the anodic oxidation film is much adhesive so as to be easily contaminated with dust in ambient, thus restricting the leveling of the paint to cause uneven coat and black spots. On the contrary, if the contact angles is larger than 80°, the anodic oxidation film is less adhesive so as to facilitate leveling the paint; however, uneven coat is caused when the paint density and coating speed are varied in an effort to maintain the image density.

Figure 2:
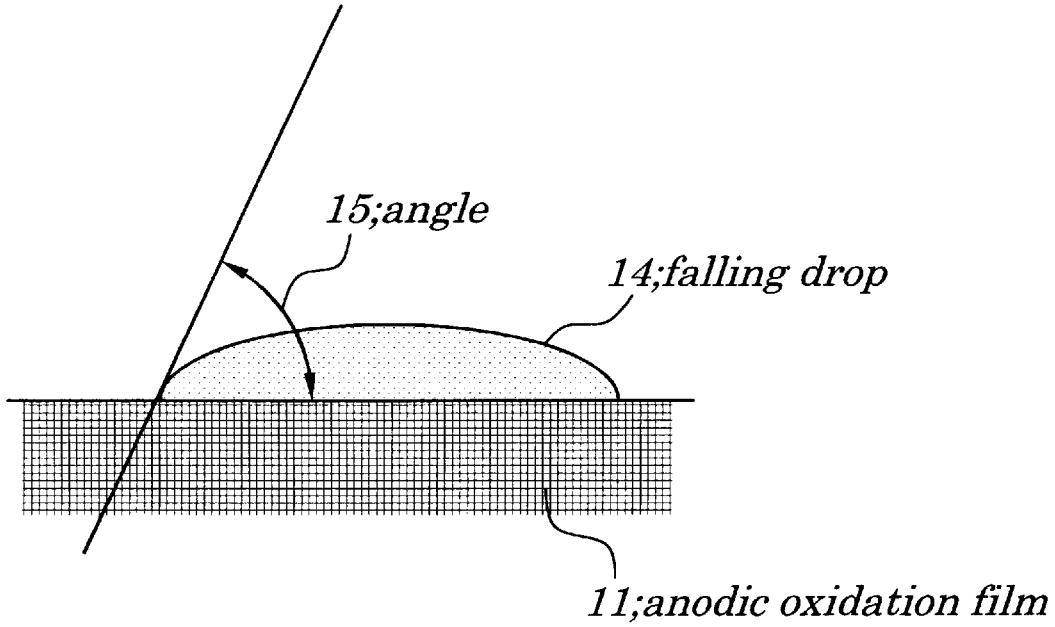
FIG. 2 is a diagram showing the manner in which a contact angle for evaluating the coatability of an anodic oxidation film surface is measured.

FIG. 2 is a diagram showing the manner in which a contact angle for evaluating the coatability of an anodic oxidation film surface is measured. In FIG. 2, the contact angle is an angle 15 of a falling drop 14 of pure water with respect to the anodic oxidation film 11.

Although there is a generally proportional relationship between the admittance and the contact angle, the admittance is less variable in a relative high range even with the lapse of time while only the contact angle varies, which would be a problem in the manufacture of a photoconductor for electrophotography.

According to the present invention, by restricting the range of the admittance and contact angle of an anodic oxidation film which is to be formed on an aluminum substrate to be used as a photoconductor for electrophotography, by controlling the size and number of crystallized lumps and pits on the aluminum substrate surface, it is possible to provide a photoconductor for electrophotography that is good in heat resistance of the substrate and in electrostatic chargeability and guarantees a good image free of any faults in various environments, thus improving the yield and the quality of the photoconductor for electrophotography.

It is thus apparent that the present invention should by no means be limited to the illustrated embodiment and various modifications and changes may be suggested without departing from the scope and spirit of the invention.

Finally, the present application claims the priority of Japanese Patent Application No. Hei9-113694 filed on May 1, 1997, which is herein incorporated by reference.

What is claimed is:

1. A photoconductor for electrophotography comprising:

a tubular aluminum substrate formed by extruding and extracting an aluminum alloy ingot into an aluminum alloy tube and by washing such aluminum alloy tube, during which the aluminum alloy ingot is heated for three or more hours at a temperature ranging from 430° C. to 550° C., wherein at least a charge generating layer and a charge transporting layer are laminated in sequence onto said tubular aluminum substrate; and an anodic oxidation film formed over the outer circumferential surface of said aluminum substrate and subject to a sealing treatment at its surface with a nickel acetate solution, said sealing treatment being carried out at a temperature of 50° C. to 70° C. for 4 to 10 minutes, a contact angle of said anodic oxidation film being in a range of 30° to 80° with respect to pure water, an admittance of said anodic oxidation film being in a range of 0.4 to 30 $S/m^2$; said aluminum substrate containing 0.3 or less % by weight of iron (Fe), 0.4 to 0.6% by weight of magnesium (Mg) and 0.1 or less % by weight of manganese (Mn), said aluminum substrate having crystallized lumps whose maximum diameter on average is 3 or less $\mu$m, said crystallized lumps being distributed over said aluminum substrate at 1000 or less per square millimeters.

2. A photoconductor for electrophotography according to claim 1, wherein said nickel acetate solution contains nickel acetate in a concentration of 5 to 10 grams per liter.

3. A photoconductor for electrophotography according to claim 1, wherein said anodic oxidation film has a thickness of 20 $\mu$m or less.

4. A photoconductor for electrophotography according to claim 3, wherein the thickness of said anodic oxidation film is within a range of 5 to 10 $\mu$m.

5. A photoconductor for electrophotography comprising:

a tubular aluminum substrate formed by extruding and extracting an aluminum alloy ingot into an aluminum alloy tube and by washing such aluminum alloy tube, during which the aluminum alloy tube is heated for three or more hours at a temperature ranging from 430° C. to 550° C., wherein at least a charge generating layer and a charge transporting layer are laminated in sequence onto said tubular aluminum substrate; and an anodic oxidation film formed over the outer circumferential surface of said aluminum substrate and subject to a sealing treatment at its surface with a nickel acetate solution, said sealing treatment being carried out at a temperature of 50° C. to 70° C. for 4 to 10 minutes, a contact angle of said anodic oxidation film being in a range of 30° to 80° with respect to pure water, an admittance of said anodic oxidation film being in a range of 0.4 to 30 $S/m^2$; said aluminum substrate having crystallized lumps whose maximum diameter on average is 3 or less $\mu$m, said crystallized lumps being distributed over said aluminum substrate at 1000 or less per square millimeters.

6. A photoconductor for electrophocography according to claim 5, wherein said aluminum substrate contains 0.3 or less % by weight of iron (Fe), 0.4 to 0.6% by weight of magnesium (Mg) and 0.1 or less % by weight of manganese (Mn).

7. A photoconductor for electrophotography according to claim 5, wherein said nickel acetate solution contains nickel acetate in a concentration of 5 to 10 grams per liter.

8. A photoconductor for electrophotography according to claim 5, wherein said anodic oxidation film has a thickness of 20 μm or less.

9. A photoconductor for electrophotography according to claim 8, wherein the thickness of said anodic oxidation film is within a range of 5 to 10 μm.

10. A method of manufacturing a photoconductor for electrophotography, comprising the steps of:

(a) preparing an aluminum alloy ingot;

(b) heating the aluminum alloy ingot at a temperature of 430° C. to 550° C. for three or more hours;

(c) extruding the aluminum alloy ingot to form a tubular aluminum substrate;

(d) heating and extracting the thus extruded tubular aluminum substrate;

(e) washing said tubular aluminum substrate thus extracted;

(f) forming an anodic oxidation film over a surface of said aluminum substrate;

(g) sealing said anodic oxidation film with a nickel acetate solution at a temperature of 50° C. to 70° C. for a period of from four to ten minutes;

(h) successively laminating a charge generating layer and a charge transporting layer onto said aluminum substrate provided with said anodic oxidation film thereon.

11. A method of manufacturing a photoconductor for electrophotography, wherein at least a charge generating layer and a charge transporting layer are laminated in sequence onto a tubular aluminum substrate, the method comprising the steps of:

(a) preparing an aluminum alloy ingot;

(b) heating the aluminum alloy ingot at a temperature of 430° C. to 550° C. for three or more hours;

(c) extruding the aluminum alloy ingot to form a tubular aluminum substrate;

(d) washing said tubular aluminum substrate thus formed through extrusion;

(e) forming an anodic oxidation film over a surface of said aluminum substrate;

(f) sealing said anodic oxidation film with a nickel acetate solution at a temperature of 50° C. to 70° C. for a period of from four to ten minutes; and (g) successively laminating a charge generating layer and a charge transporting layer onto said aluminum substrate provided with said anodic oxidation film thereon.

12. A photoconductor for electrophotography according to claim 11, wherein said nickel acetate solution contains nickel acetate in a concentration of 5 to 10 grams per liter.

13. A photoconductor for electrophotography according to claim 10, wherein said nickel acetate solution contains nickel acetate in a concentration of 5 to 10 grams per liter.

14. A method according to claim 10, wherein said aluminum substrate contains 0.3 or less % by weight of iron (Fe), 0.4 to 0.6% by weight of magnesium (Mg) and 0.1 or less % by weight of manganese.

* * * * *